US011839282B2

(12) United States Patent
Shalgi

(10) Patent No.: US 11,839,282 B2
(45) Date of Patent: Dec. 12, 2023

(54) SPLIT HANDLE, NARROW ROLLING BAG

(71) Applicant: ORG Group, LLC, Los Angeles, CA (US)

(72) Inventor: Netta Dor Shalgi, West Hollywood, CA (US)

(73) Assignee: ORG GROUP, LLC, Los Angeles, CA (US)

( * ) Notice: Subject to any disclaimer, the term of this patent is extended or adjusted under 35 U.S.C. 154(b) by 0 days.

(21) Appl. No.: 17/607,494

(22) PCT Filed: Mar. 19, 2020

(86) PCT No.: PCT/US2020/023688

§ 371 (c)(1),
(2) Date: Oct. 29, 2021

(87) PCT Pub. No.: WO2020/197946

PCT Pub. Date: Oct. 1, 2020

(65) Prior Publication Data

US 2022/0218080 A1 Jul. 14, 2022

Related U.S. Application Data

(60) Provisional application No. 62/822,642, filed on Mar. 22, 2019.

(51) Int. Cl.
*A45C 5/14* (2006.01)
*A45C 13/26* (2006.01)

(52) U.S. Cl.
CPC ..... *A45C 5/14* (2013.01); *A45C 13/26* (2013.01); *A45C 2013/267* (2013.01)

(58) Field of Classification Search
CPC ..... A45C 5/14; A45C 13/26; A45C 2016/267
See application file for complete search history.

(56) References Cited

U.S. PATENT DOCUMENTS

| | | | | |
|---|---|---|---|---|
| 3,653,474 A | | 4/1972 | Sadow | |
| 4,966,259 A | * | 10/1990 | Bergman | A45C 13/262 190/117 |
| 5,996,180 A | | 12/1999 | Eisenzopf | |
| 10,143,279 B2 | * | 12/2018 | Pitchforth | A45C 7/0036 |

(Continued)

FOREIGN PATENT DOCUMENTS

| | | |
|---|---|---|
| DE | 2522500 B1 | 3/1976 |
| GB | 2564455 A | 1/2019 |

OTHER PUBLICATIONS

PCT International Preliminary Report on Patentability dated Sep. 28, 2021 for International Application No. PCT/US2020/023688, 8 pages.

(Continued)

*Primary Examiner* — Tri M Mai
(74) *Attorney, Agent, or Firm* — RMCK Law Group, PLC

(57) ABSTRACT

The present invention is directed to a rolling suitcase that is pulled depthwise rather than breadthwise, and incorporates a split handle that separates when the suitcase is to be opened. The split handle may incorporate a locking mechanism that includes a mechanical, magnetic, or other connector for locking and releasing the split handle halves. The suitcase maximizes internal volume by the use of inset wheels and handle extensions, and also provides for protections against many common types of breakage.

15 Claims, 16 Drawing Sheets

(56) References Cited

U.S. PATENT DOCUMENTS

| | | | | |
|---|---|---|---|---|
| 2002/0153707 | A1* | 10/2002 | Kady | B62B 1/125 280/652 |
| 2003/0084543 | A1 | 5/2003 | Sadow | |
| 2005/0012287 | A1* | 1/2005 | Goldenberg | B62B 9/20 280/47.38 |
| 2008/0236972 | A1 | 10/2008 | Lee et al. | |
| 2014/0311845 | A1* | 10/2014 | Ling | A45C 5/03 190/115 |
| 2017/0332759 | A1 | 11/2017 | Yamamoto | |
| 2018/0327043 | A1 | 11/2018 | Kang | |
| 2021/0120925 | A1* | 4/2021 | De Vos | A45C 13/262 |

OTHER PUBLICATIONS

PCT International Search Report and Written Opinion dated May 19, 2020 for International Application No. PCT/US2020/023688, 9 pages.

Extended European Search Report dated Oct. 17, 2022 for European Patent Application No. 20778732.6, 7 pages.

* cited by examiner

SPLIT HANDLE, NARROW ROLLING BAG

CROSS-REFERENCE TO RELATED APPLICATIONS

This application is a 371 U.S. National Stage of International Application No. PCT/US2020/023688, filed Mar. 19, 2020, which claims priority to U.S. Provisional Patent Application Ser. No. 62/822,642, filed Mar. 22, 2019. The disclosures of the above applications are incorporated herein by reference in their entirety.

BACKGROUND

The United States Luggage Company is generally credited with being the first company to place wheels on a suitcase almost fifty years ago. U.S. Pat. No. 3,653,474 (1970) entitled "Rolling Luggage" reflects this crowning achievement, and now almost every luggage piece is formed with some means for rolling. There has been many, many patents that have followed the '474 Patent in trying to improve the manner in which luggage is used, especially the way it is carried.

The present application uses the term "suitcase" in a broad sense to describe a wide variety of bags, from soft cover to hard shell, and the term is to be considered in the broadest possible terms for the purposes of this application.

If a case when set down has the extendable handle on the top surface, the greater lateral dimension will be referred to as width and the lesser lateral dimension will be referred to as depth, with height being the top to bottom dimension. This nomenclature will remain, even though when the suitcase is laid flat and opened, the position is changed and height is no longer top to bottom and depth is no longer front to back. Maintaining this nomenclature will prevent confusion in the description of the invention. The usable volume of the suitcase is the effective height×the effective width×the effective depth.

Typical rolling suitcases today are equipped with a handle that extends or telescopes from a top portion of the case. The rods or poles that extend the handle are situated on the same half of the suitcase, and the case has at least two wheels at the bottom surface of the case along an edge defining the width. While this position requires that the case be rolled traverse to the width and thereby move the largest profile, this situation is necessary so that the two poles do not straddle the opening of the case. Travelers have often lamented the fact that while attempting to navigate crowded airports, walkways, sidewalks, and the like, the breadth of the rolling case is sometimes more inconvenient that carrying the case in the narrow (depth) direction. Unfortunately, heretofore placing a solid handle across the depth instead of the width precludes the case from opening properly.

SUMMARY OF THE INVENTION

The present invention is a rolling suitcase that is pushed or pulled depthwise rather than in the width position. The suitcase of the present invention also employs several novel features to maximize storage capacity, facilitate easy and reliable locking and unlocking of the handle mechanism, and other features explained in greater detail below.

The centerpiece of the present invention is a split handle that separates when the case needs to be opened, and locks when the case is pulled or locked. In a first preferred embodiment, the handle splits in the middle to form two separate (albeit not necessarily equal) halves, such that the case can quickly open and close.

DETAILED DESCRIPTION OF THE PREFERRED EMBODIMENTS

Figure 1:
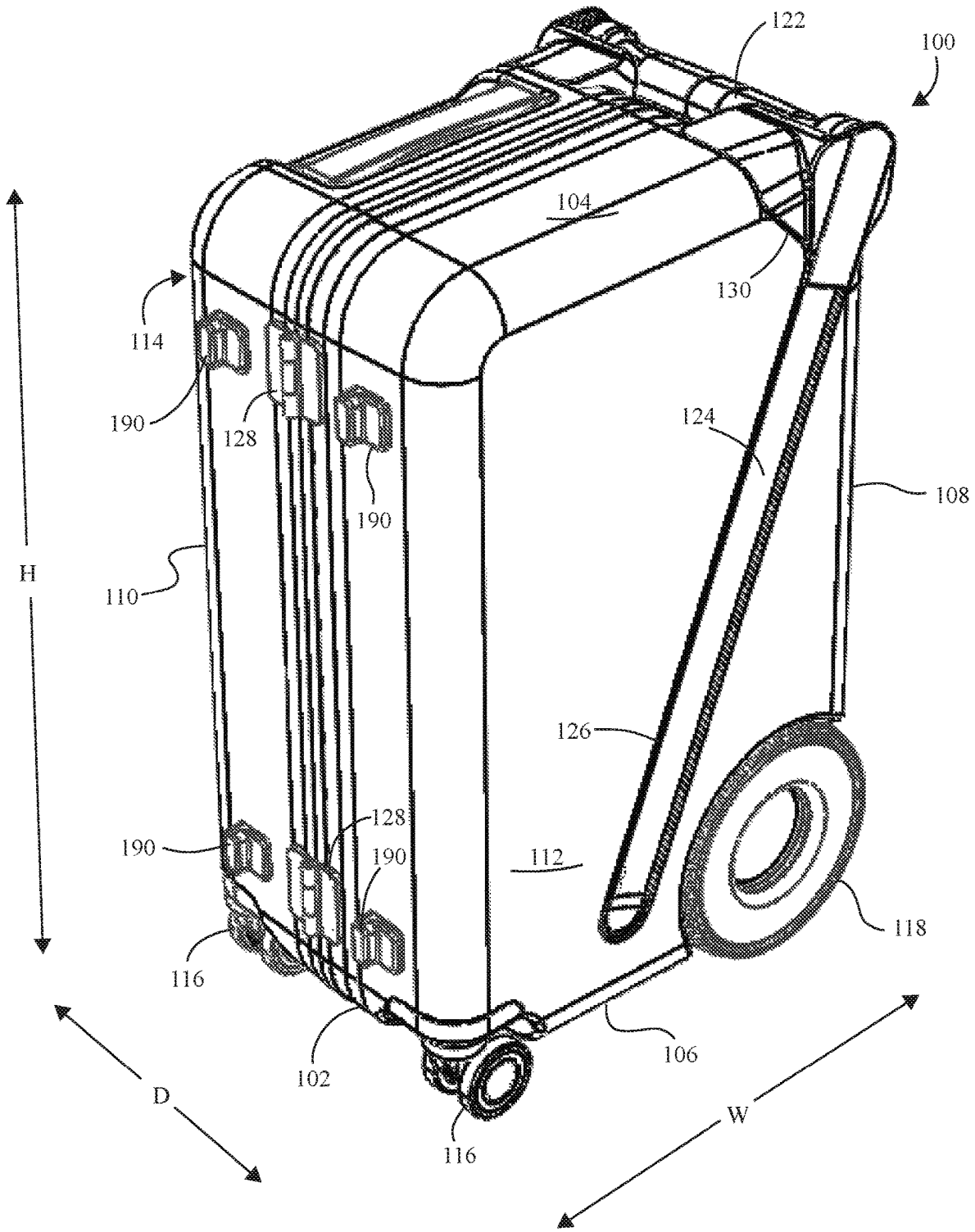
FIG. 1 is an elevated, perspective view of a first embodiment of the present invention.

FIG. 1 is an elevated, perspective view of a first preferred embodiment of the present invention, depicting a suitcase 100 generally having a right half 101 and a left half 102. The suitcase 100 is characterized by a height "H," a width "W," and a depth "D" when resting on its wheels as shown in FIG. 1. For purposes of describing the features of the invention, the suitcase has a top end 104, a bottom end 106, a front end 110, a rear end 108, a left side 112, and a right side 114. In a first embodiment, the suitcase 100 is equipped with multi-direction small wheels 116 (also known as "spinners") at the front bottom edge, the wheels capable of swiveling about a vertical support to allow the wheels to turn three hundred sixty degrees in order to better steer the case. Opposite wheels 116 are two larger, inset wheels 118 at the rear bottom edge. Wheels 118 are inset from the left and right sides of the case so as to be fully within the profile of the case, i.e., within the planes defined by the left and right sides. The large wheels 118 roll over larger discontinuities/bumps/curbs/etc. and allow a user to easily establish the center of gravity of the case over the wheels for balancing purposes, reducing any moment of inertia and making the case seem more lightweight when it's center of mass is balanced over the wheels 118. When rolling the case on two wheels, a user will push downward on the main handle rather than lifting the handle, which also involves bearing the weight on the user's arm. The large wheels also promote a straight direction of travel, as opposed to smaller wheels that can cause jitter or non-linear travel.

The top 104 of the case may be equipped with a grip or strap 120 fixed at each end to allow the case 100 to be quickly grasped and lifted up. The strap 120 has some slack to allow the fingers of a user to slip under to grasp the strap. The case is also equipped with an extendable/telescoping handle 122 that is used to pull/steer/push/maneuver the suitcase. The extendable handle 122 attaches to the case through left and right inset rails, tubes, or shafts 124 that are each seated in a conforming channel 126 formed in the right and left sides. The shafts 124 move entirely within the channels 126 so as to add nothing to the depth of the case, while extending out and away from the body of the case while remaining within the frame of the sides 112, 114. That is, the shafts 124 do not extend outside of the plane defined by the left and right sides of the suitcase. The shafts 124 and channels 126 are shown in the figures to be diagonal and straight, but in alternate embodiments can be curved or oriented in other directions.

Figure 2:
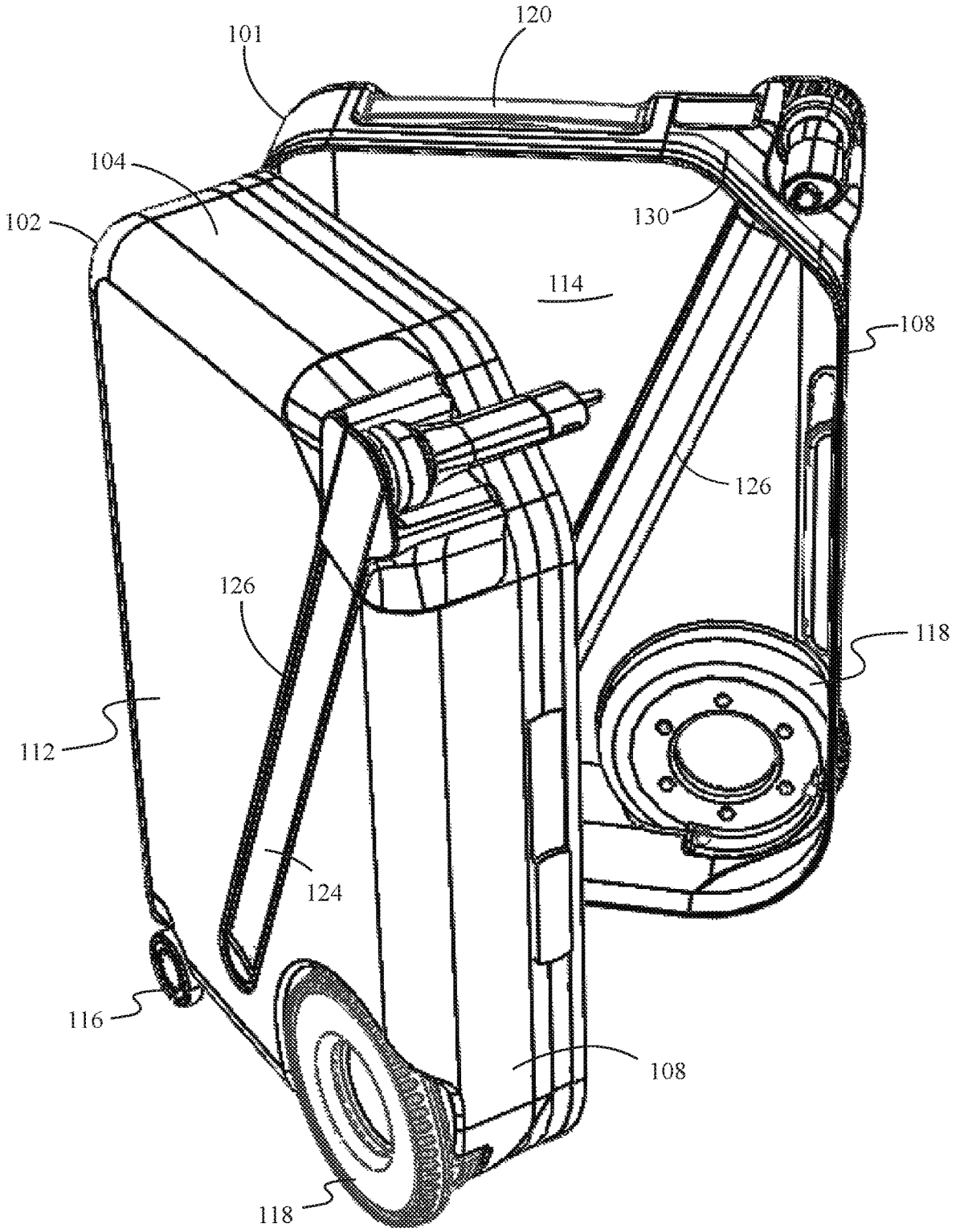
FIG. 2 is an elevated, perspective view of the embodiment of FIG. 1 in an ajar configuration.
Figure 3:
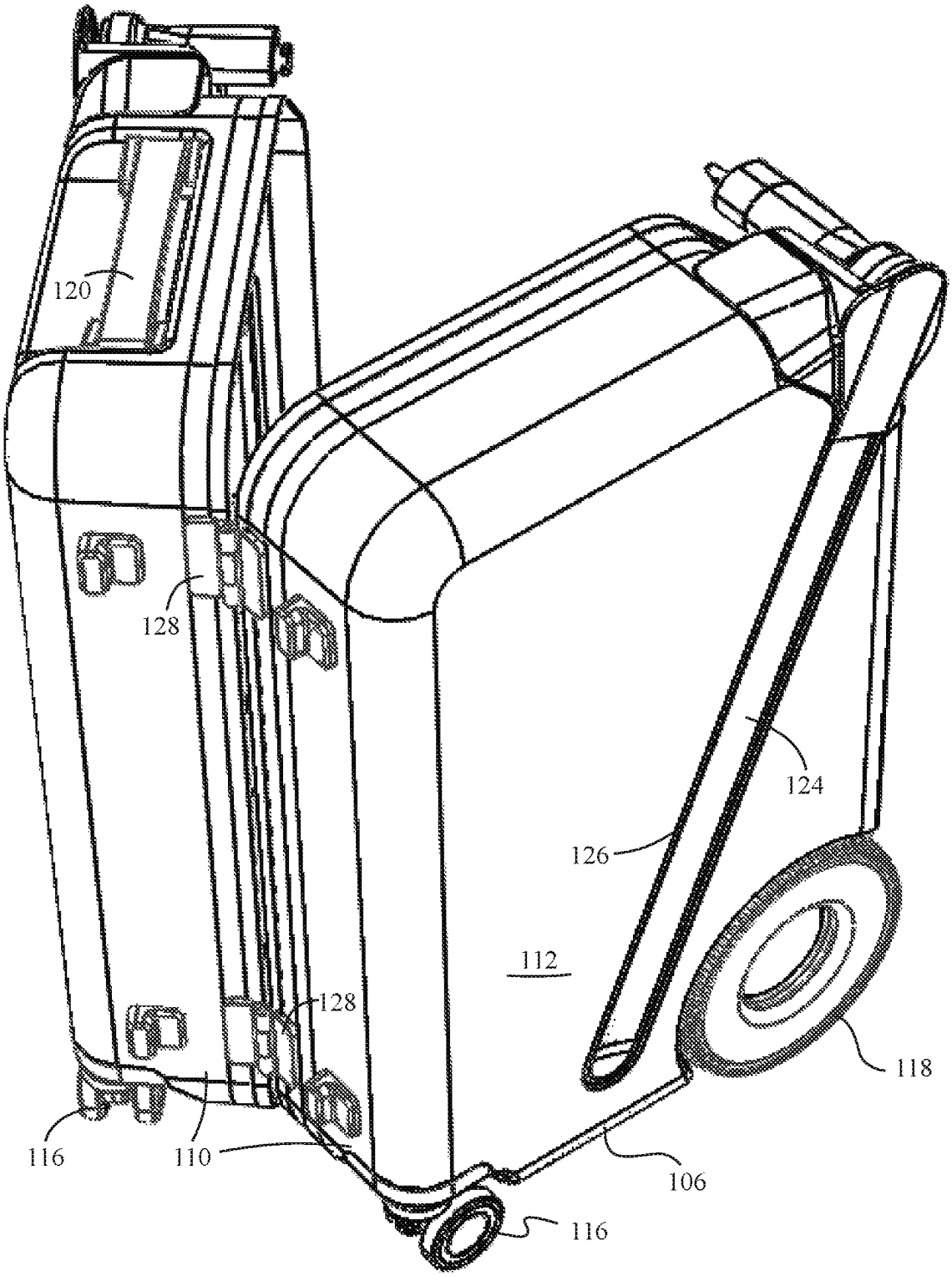
FIG. 3 is a reverse elevated, perspective view of the embodiment of FIG. 2.

FIG. 2 illustrates the embodiment of FIG. 1 in a slightly ajar position. The left half 102 and right half 101 are pivoted open about hinges 128 to expose the interior of the suitcase 100. It can be seen that the top rear corner 130 of the suitcase 100 is truncated with a bevel such that the split handle 122 is within the exterior space formed by the truncation of the corner. It can also be seen in FIG. 2 that the handle 122 separates into left and right components to allow the left half 102 and right half 101 of the suitcase to separate and open. Heretofore, a handle would be located exclusively on one of the halves, allowing the case to be pulled/pushed breadthwise. The present design allows the case to be pulled/pushed depthwise, significantly reducing the profile of the suitcase in the moving direction. FIG. 3 shows the same configuration from the opposite side.

Figure 4:
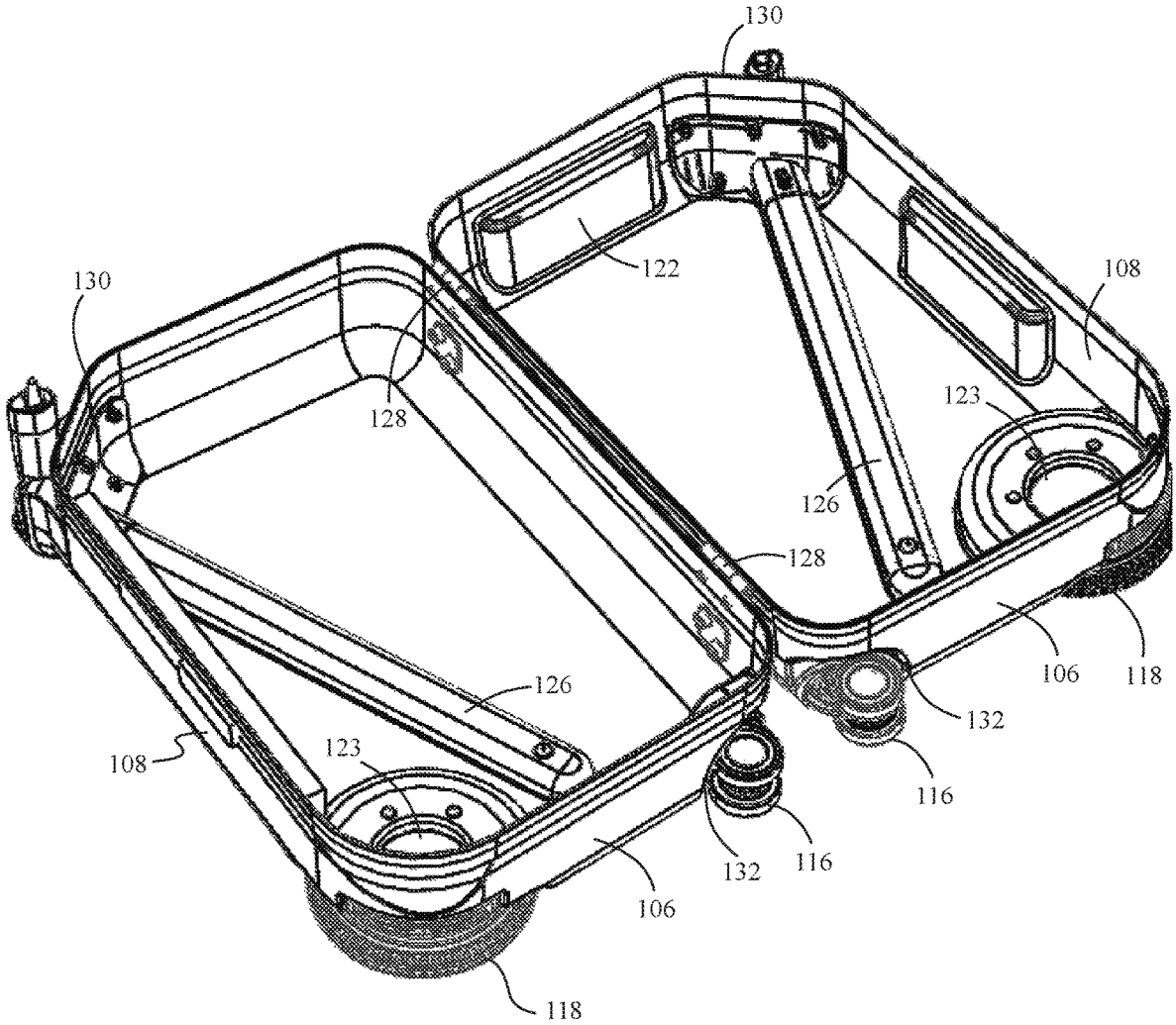
FIG. 4 is an elevated, perspective view of the embodiment of FIG. 1 in the laid open configuration.
Figure 5:
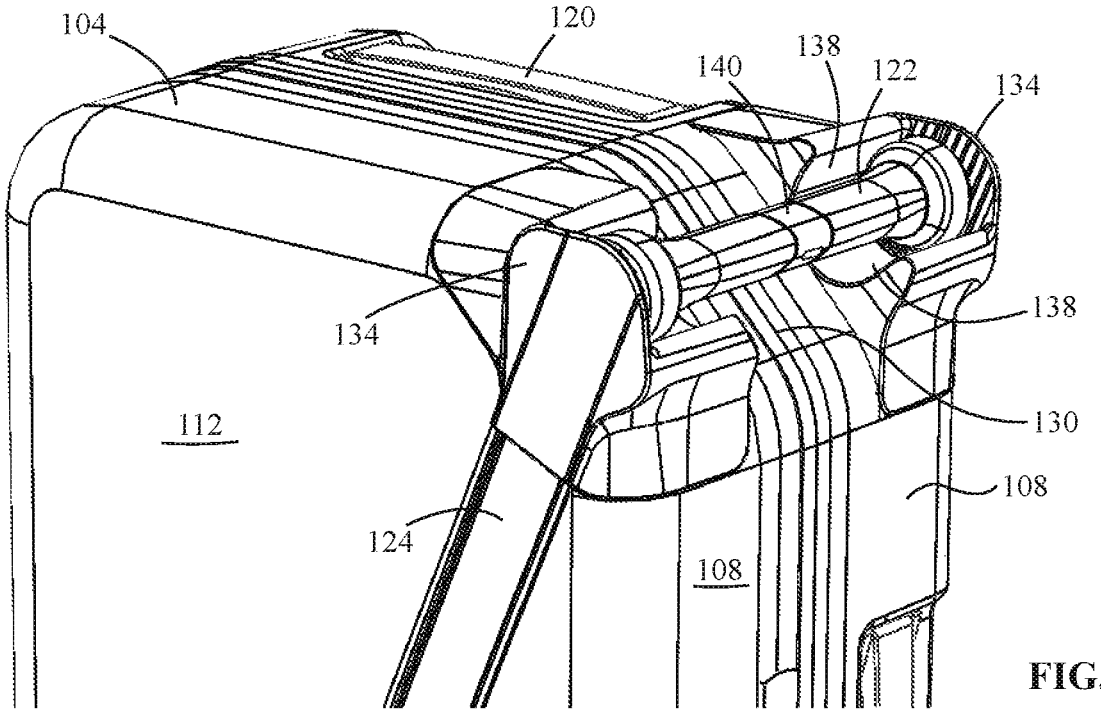
FIG. 5 is an enlarged, perspective view of the split handle.

FIG. 4 illustrates the embodiment of FIG. 1 is the splayed or fully open position with the interior exposed. From this view, some features of the invention become more readily apparent. There is no lost volume in the interior due to a transverse axle for the large wheels (which are instead mounted on mounted hubs 123). Also, by inserting the shafts 124 in the channels 126, the depth of the suitcase is enlarged to the maximum depth allowed by Federal regulations. If the shafts 124 were outside the sides 112, 114, then then entire volume accommodating the dimension of the shaft would be lost. It can also be seen that the wheels 116 are protected within a cavity 132 to reduce the opportunity for sideways impact of the wheels. It is well known in the industry that the wheels are a major fault point for premature breakage or for disabling the suitcase, and that lateral impact is the leading cause of wheel breakage. The design of the present invention to locate the wheels in the cavity 132 protects the wheels from lateral forces that can bend, break, or incapacitate the wheels' function.

Figure 12:
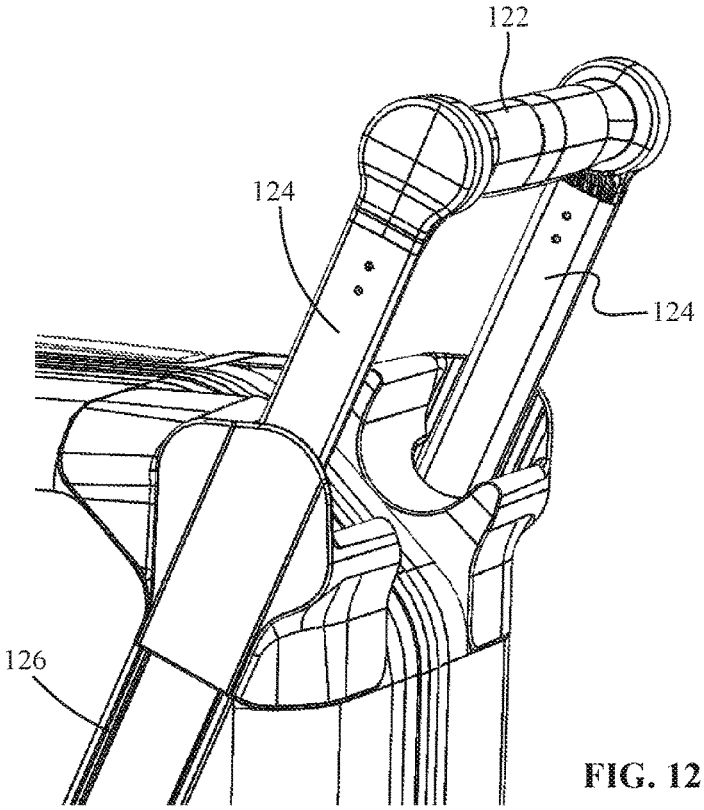
FIG. 12 is an enlarged, perspective view of the split handle extended.
Figure 13:
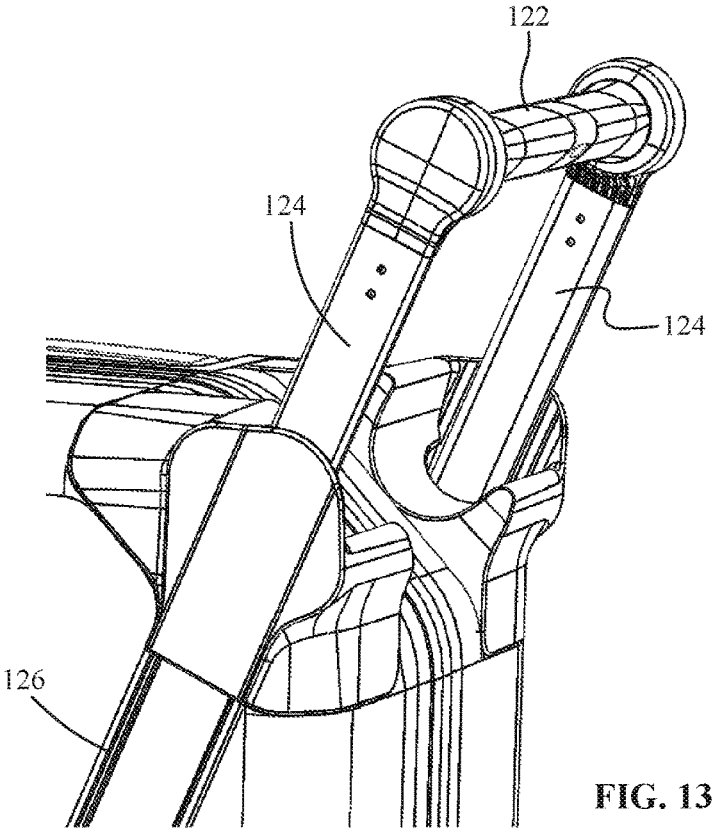
FIG. 13 is an enlarged, perspective view of the split handle extended and locked.

FIGS. 5-8 illustrate a first embodiment of a split handle 122 and locking mechanism for use with the present invention. The outsides of the top rear corners include shield plates 134 that enclose and protect the split handle 122. As with the wheels 116, 118 the handle 122 is a location that can easily break or malfunction from lateral impact due to normal baggage handling, being dropped on a corner, impact from other baggage being stacked or collected, etc. The shield plates 134 prevent direct impact laterally on the handle 122, while keeping within the frame of the suitcase so as not to add any unnecessary depth. The top 104 and rear end 108 of the suitcase 100 also cooperate to form C-shaped barriers 138 that enclose and protect the ends of the split handle 122. The C-shaped barriers 138 occupy the space formed by the beveling of the corner 130 so that no additional space is used for this purpose. The C-shaped barriers 138 leave exposed a portion of the middle of the split handle 122, allowing it to be easily grasped due to the spacing between the beveled corner 130 and the split handle 122. When the handle 122 is pulled along the direction of the channels 126, the handle 122 and the shafts 124 extend away from the body of the suitcase and permit the handle 122 to assume the towing configuration (see, e.g., FIG. 12).

To prevent the split handle 122 from inadvertently separating, a novel locking mechanism is incorporated into the handle 122 in a first embodiment. The handle 122 may be formed with an ovular or egg-shaped profile (or any other ergonomic shape) having a substantially circular or oval portion and an angled or wedge-shaped portion. In the locked configuration of FIG. 5, the circular or oval portion is adjacent the surface of the corner 130 such that, when grasped, it will bear against the user's pad of the palm. A centrally disposed rotatable actuator 140 shares the profile of the handle 122, and rotates about an axis co-linear with the handle itself so as to pivot out of conformity with the rest of the handle (see FIG. 6). A release button 149 is disposed on the front of the actuator, and when depressed releases the actuator 140 to permit the rotation to the unlocked position. The actuator 140 will only rotate when the release button 149 is depressed, and rotation is made against the bias of the spring. The release button 149 allows a user to press the release button 149 to release the actuator 140 and rotate the actuator all in one motion with one finger. In one preferred embodiment, a spring biases the actuator 140 in the conformed, or locked position, so that a manual force is needed to overcome the spring and unlock the handle for separating. This prevents the handle from inadvertently separating and potentially allowing the case to open.

Figure 7:
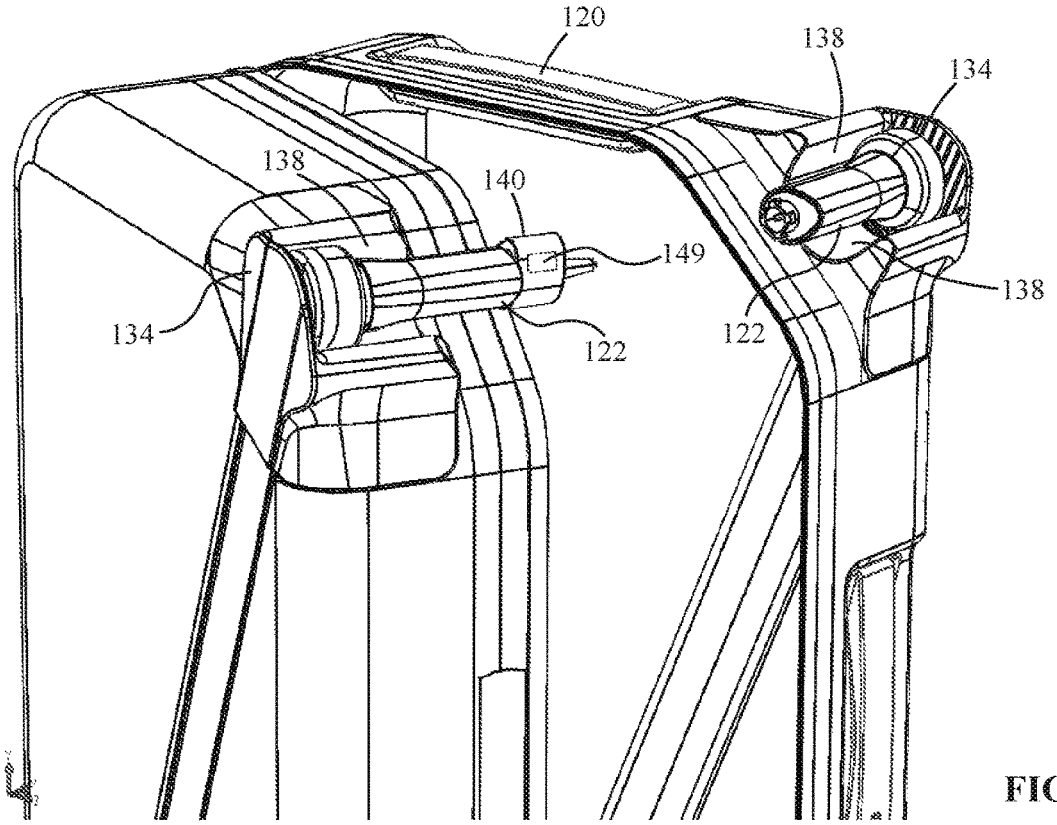
FIG. 7 is an enlarged, perspective view of the split handle in the separated position.
Figure 8:
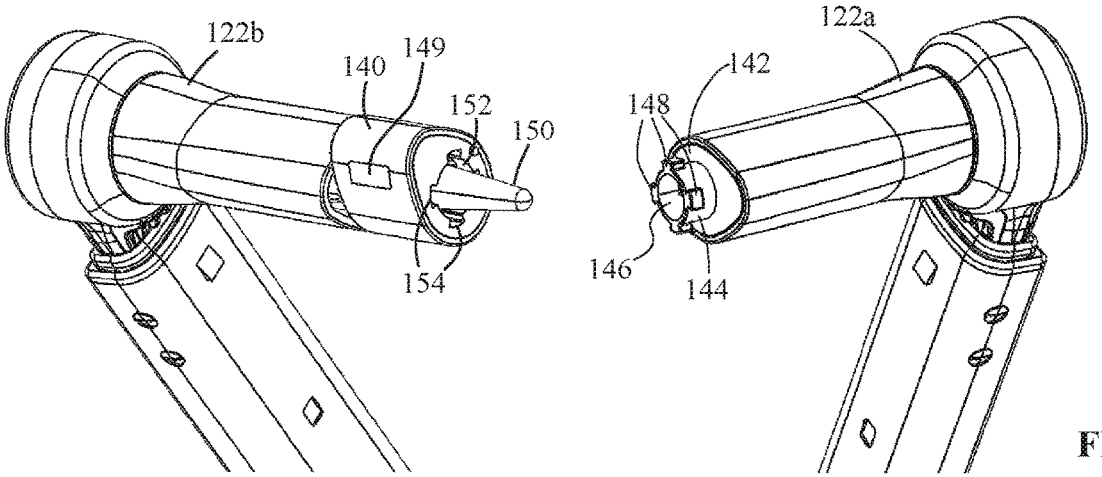
FIG. 8 is an elevated, perspective view of the split handle locking mechanism.
Figure 9:
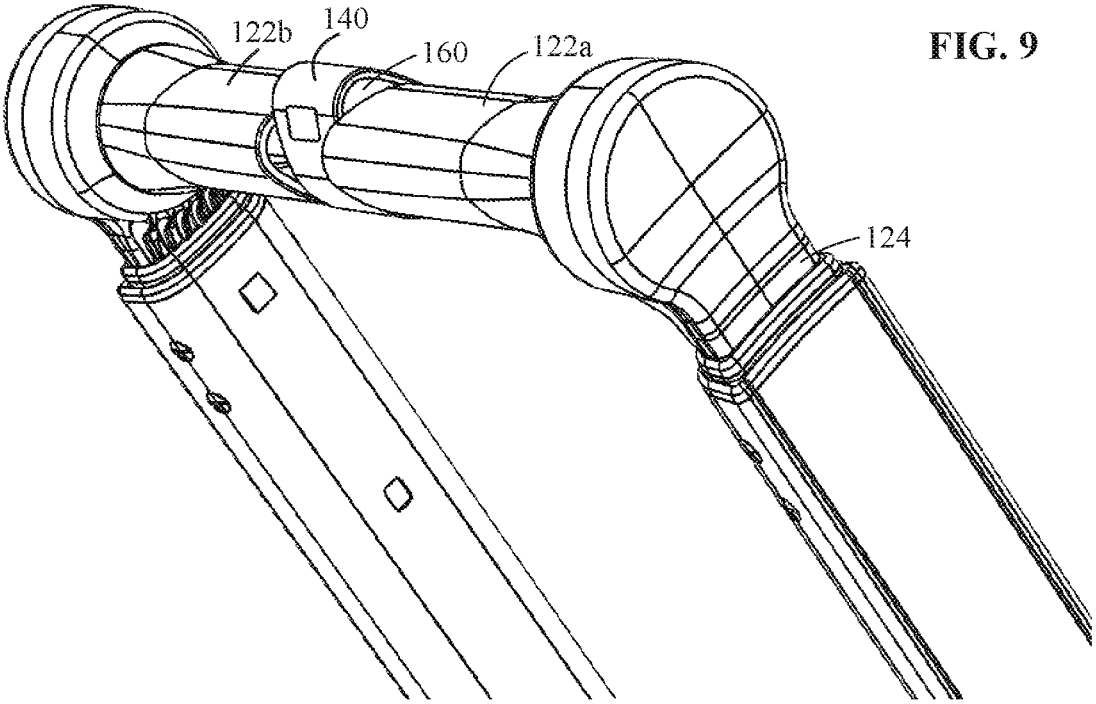
FIG. 9 is an elevated, perspective view of the split handle with an unlocked indicator.

FIGS. 7 and 8 illustrate the split handle 122 is the separated condition, with the actuator 140 in the rotated, unlocked position. The right side 122*a* of the handle at the interface 142 includes a cylindrical projection 144 with an open center 146. The end of the cylindrical projection 144 includes a plurality of radial tabs 148 spaced around the circumference of the projection. The left side 122*b* of the handle comprises a support pin 150 that, when inserted into the open center 146 of the cylindrical projection 144, serves to reinforce the connection between the left and right sides of the handle, and by this create a solid unified handle grip. The left side 122*b* of the handle also comprises an opening 152 about the support pin 150 with channels 154 coinciding with the tabs 148 of the cylindrical projection 144 so that the handle can open and close only when the actuator 140 is rotated to the unlocked position of FIG. 8. That is, the cylindrical projection 144 passes through the opening 152 and the tabs 148 align with the channels 154 to close the split handle 122, and when the actuator is rotated to the unlocked position the left side 122*b* and the right side 122*a* can separate. However, with the cylindrical projection 144 inserted into the opening 152 and the actuator 140 rotated to the locked position, the cylindrical projection 144 is captured and cannot be removed due to the misalignment of the tabs 148 with the channels 154. In this manner, the handle 122 can be secured in the locked position without opportunity to inadvertently separate, and with the push of a thumb against the actuator 140 the handle can be easily separated to allow the suitcase to open. In FIG. 9, the exposed sides 160 of the actuator 140 can be colored or marked with a bright or eye-catching color (e.g., red, yellow, phosphoric, etc.) to ensure that the user is aware of the actuator's position is in the unlocked position where it can separate. This prevents the suitcase from accidentally opening and prevents the handle from accidentally separating when the case is supposed to remain locked.

Figure 10:
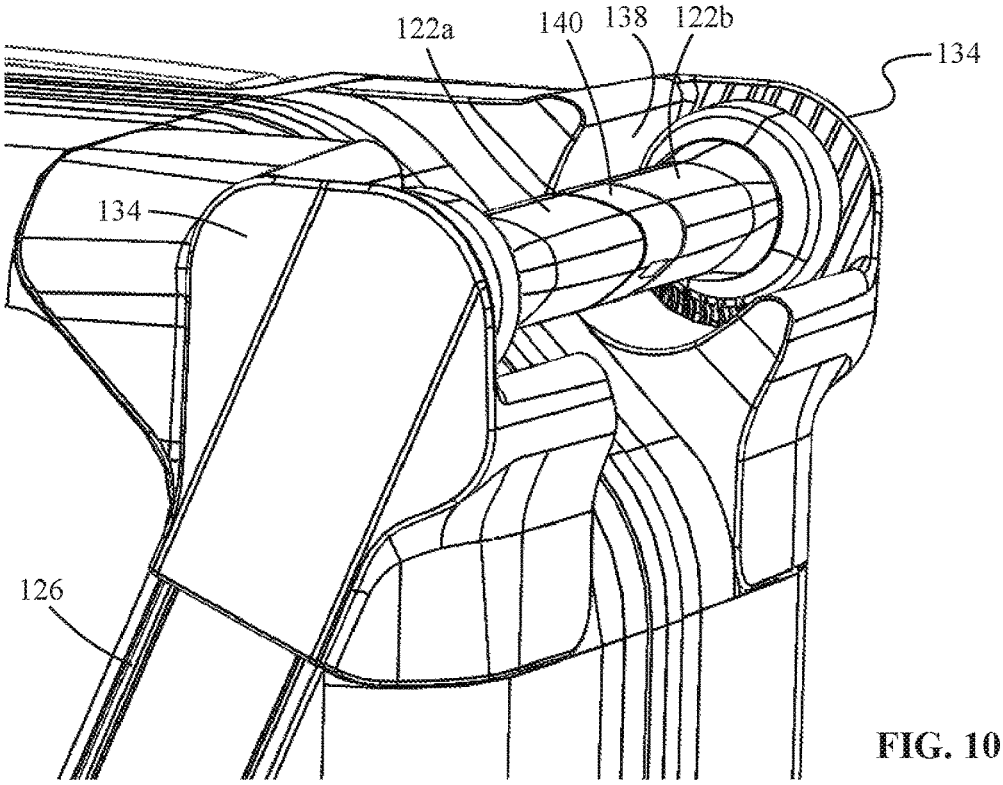
FIG. 10 is an enlarged, perspective view of the split handle in the extension lock position.
Figure 11:
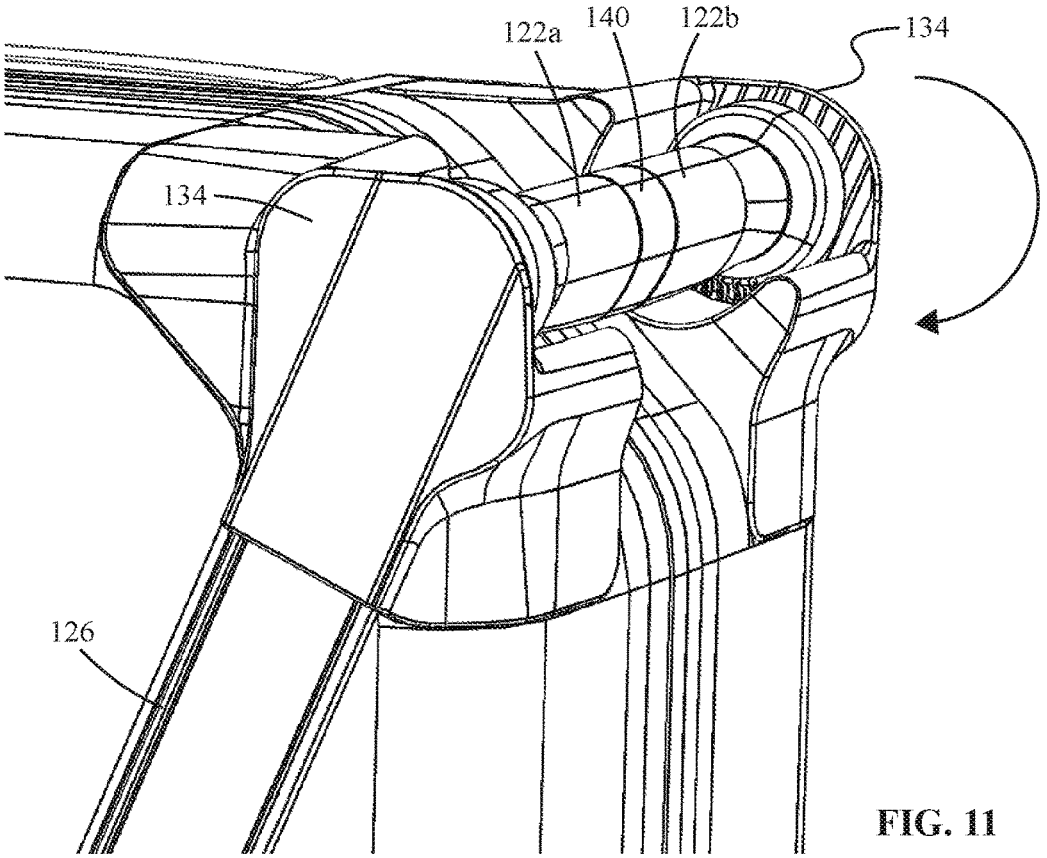
FIG. 11 is an enlarged, perspective view of the split handle in the extension unlock position.

The handle 122 extraction from the case is now described with reference to FIGS. 10-15. The shafts 124 of the suitcase 100 are initially locked in the channels 126 and cannot be extended until the handle is "released" by rotating the handle downward. FIG. 10 shows the handle 122 in the locked position with the wedge-shaped portion of the handle facing away from the C-shaped barriers and toward the user. If the user manually rotates the handle (including the actuator 140) downward (i.e., clockwise in FIG. 10) to the position shown in FIG. 11, the shafts 124 become "released" from their respective channels 126 and the handle can be pulled out (FIG. 12) as long as the handle is rotated in the downward position of FIGS. 11 and 12. Once the handle is released or rotated back to the locked position of FIGS. 10 and 13, the shafts can no longer extend or retract from their channels and the handle's extension is fixed. This allows a user to establish a comfortable handle separation distance based on the height of the user, the weight of the suitcase, etc. The mechanism by which the handle is released, locked, and fixed, as described below, allows the handle to be located anywhere between a fully extended and fully retracted position by rotating the handle 122 into the locked position.

Figure 14:
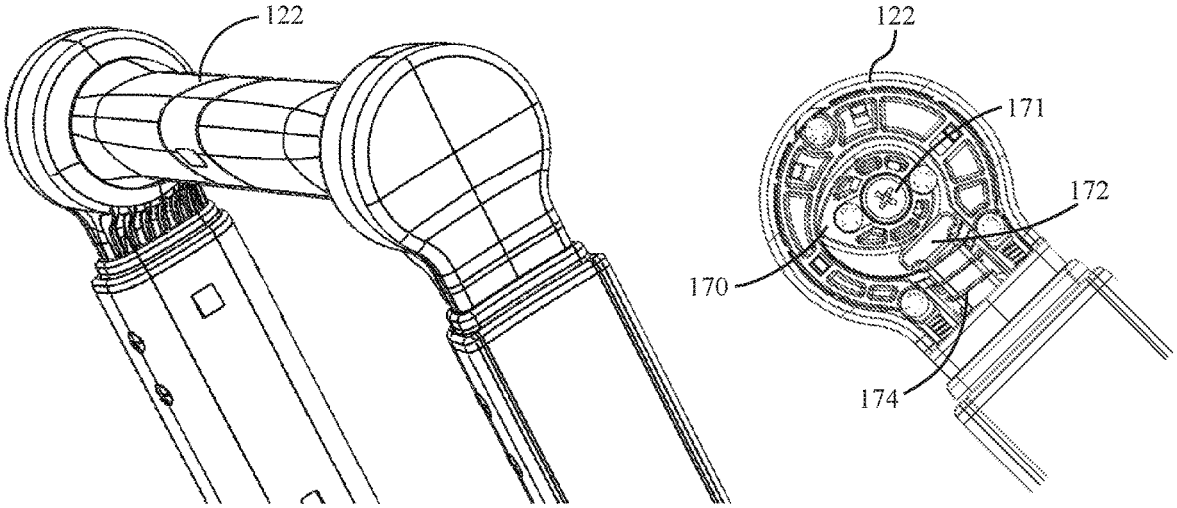
FIG. 14 is a cross sectional view of the cam locking mechanism for the extendible handle.
Figure 15:
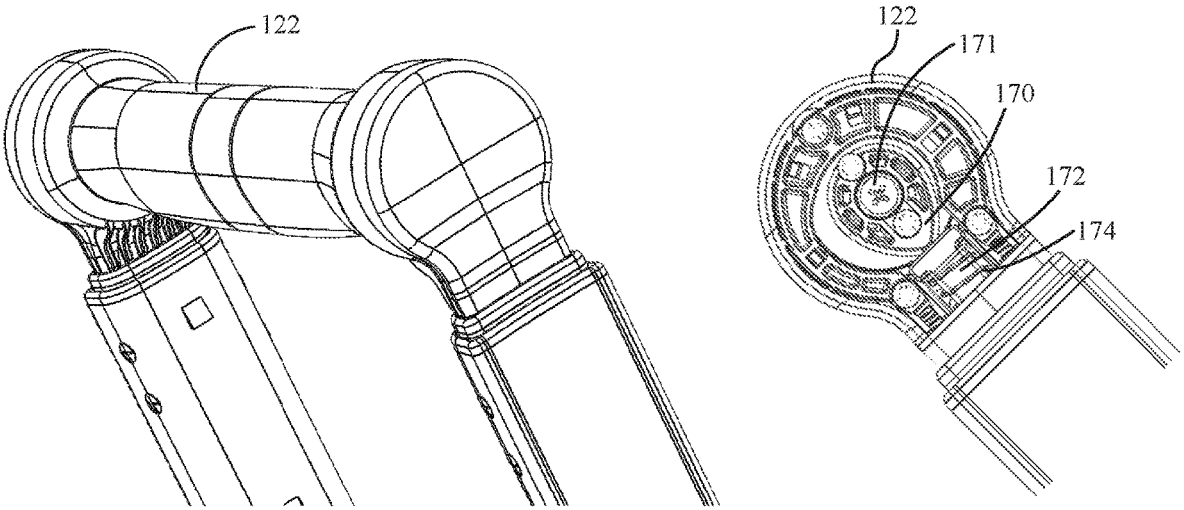
FIG. 15 is a cross sectional view of the cam locking mechanism in the released position.

FIGS. 14 and 15 illustrate one type of actuating and locking mechanism for the handle release and extension system of the present invention. The central axis of the handle 122 mounts a an axle 171 that supports a cam member 170 in contact with a spring back mechanism actuated pin 172. The pin 172 is coupled to a locking mechanism for locking the shafts within the channel when the pin is in an extended position. That is, when the handle 122 is in the locked position of FIG. 14, the cam member 170 is rotated such that the pin 172 bears against the cam member and is fully extended. With the pin 172 in this position, the locking mechanism is engaged and the shaft 124 of the suitcase is locked and cannot extend or retract into the channel 126. In FIG. 15, handle 122 has been rotated to the unlocked position, and the cam member 170 has driven the pin 172 downward against the bias of the spring 174. With the pin 172 in this retracted position, the locking mechanism is disengaged and the shaft 124 can extend from or retract into the channel 126.

Figure 16:
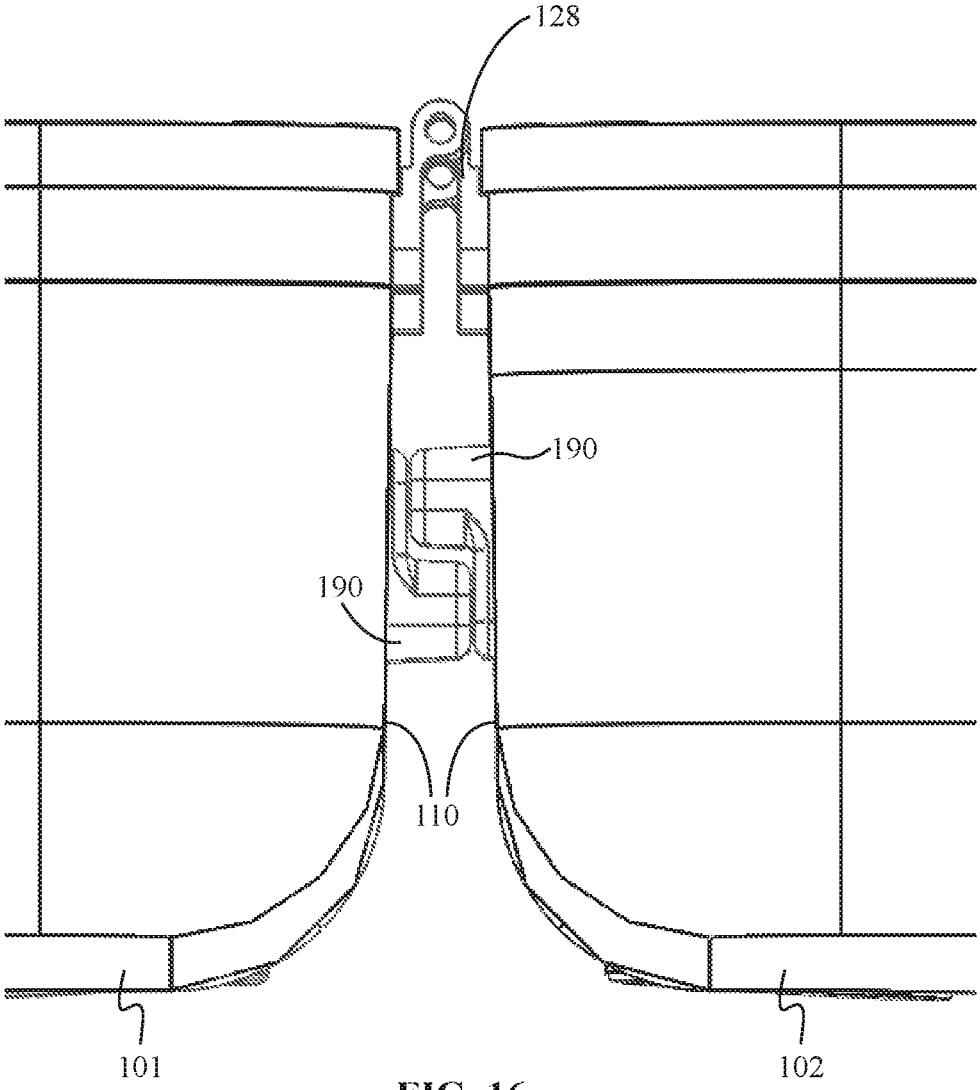
FIG. 16 is a sectional view of the interlocking bumpers.

FIG. 16 illustrates a pair of mating bumpers 190 on the front panel 110 of each side 101, 102. The bumpers are generally L shaped and are sized such that the opposed bumpers 190 slightly touch each other when the suitcase is in the open configuration of FIG. 4. The shape of the bumpers 190 ensure that the projection portion of the bumpers makes contact with the flat portion of the opposed bumpers, eliminating the opportunity for wear due to contact of the bumpers with the body of the case.

Figure 17:
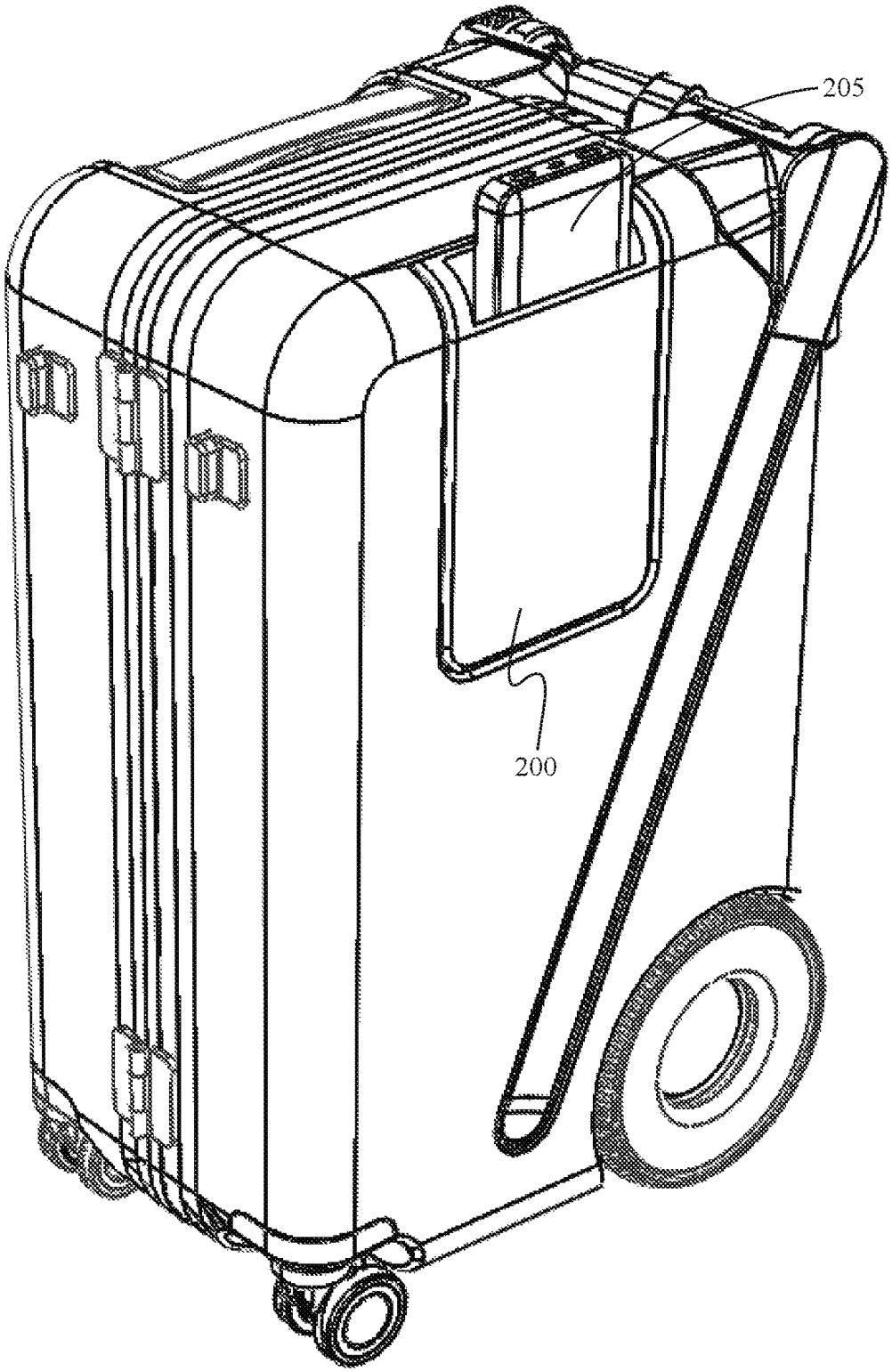
FIG. 17 is an elevated, perspective view of another embodiment with a side pocket.

FIG. 17 illustrates an optional feature of a convenient side pocket 200 that can store an electronic device 205, keys, wallet, and the like. The side pocket can be closed with a zipper, flap, or other closure means to secure the contents of the pocket 200.

Figure 18:
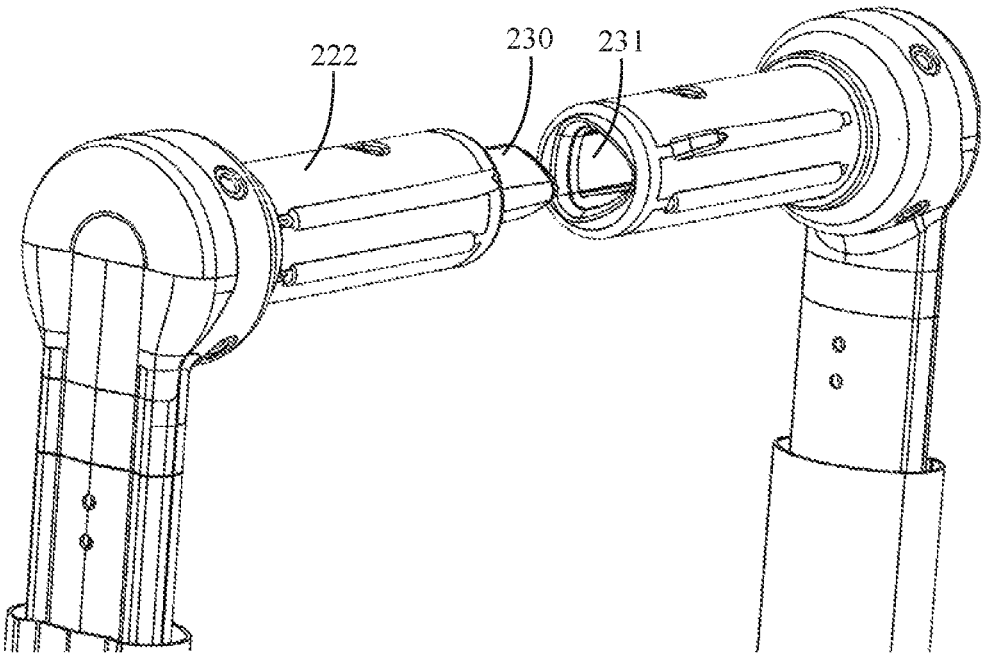
FIG. 18 is an enlarged, perspective view of an alternate magnetic handle locking mechanism.
Figure 19:
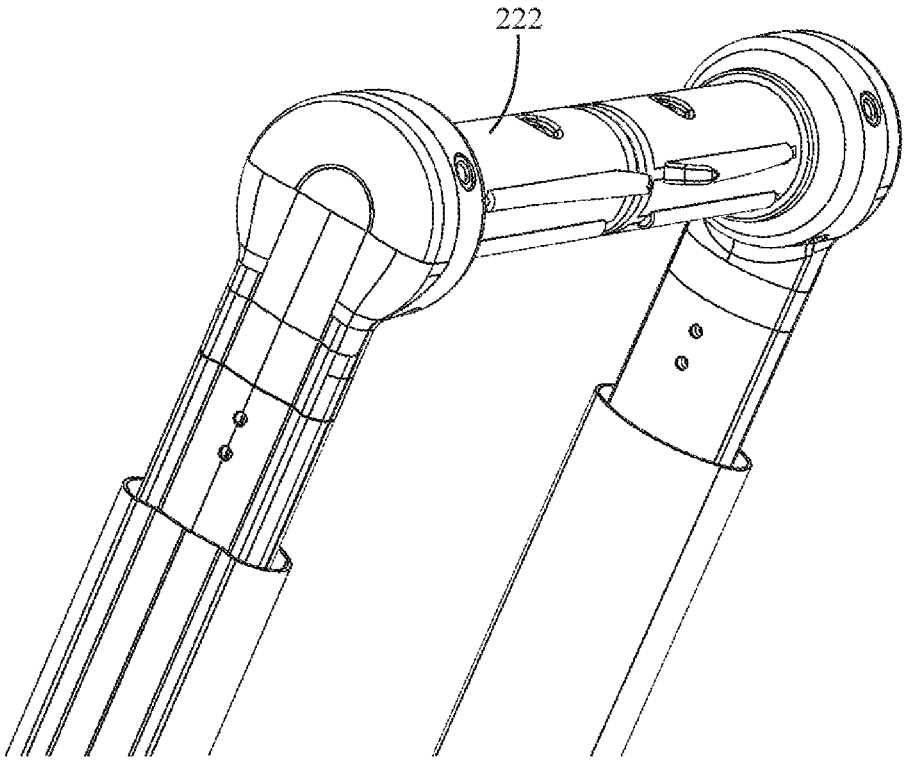
FIG. 19 is an enlarged, perspective view of the alternate magnetic handle locking mechanism in the attached configuration.

FIGS. 18 and 19 illustrate an alternate locking mechanism for the split handle 222. A first component of the handle includes a locking pin 230 having a non-circular profile, and the opposing component includes a cavity 231 having a matching non-circular profile, such that the locking pin 230 can insert into the cavity 231 when the first and second components are engaged. The two components can be held in place by a magnetic coupling, such that the components are magnetically attracted to each other but can be separated by breaking the magnetic attachment.

Figure 6:
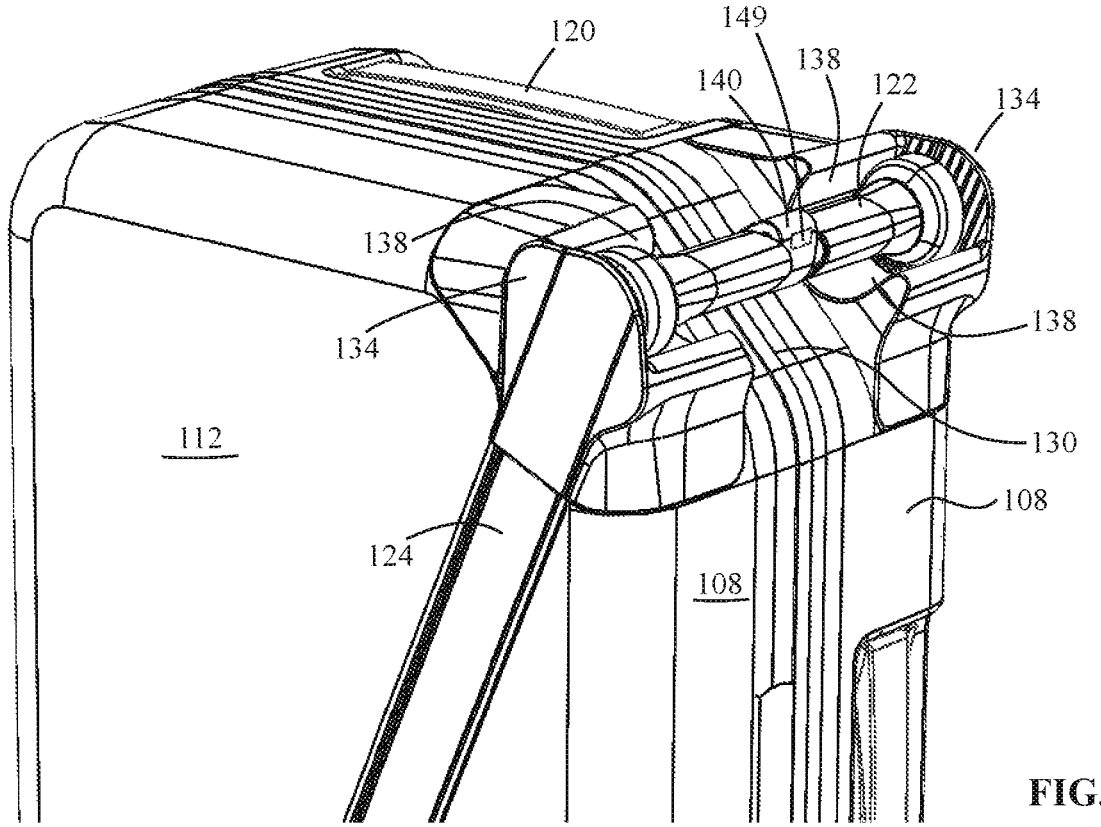
FIG. 6 is an enlarged, perspective view of the split handle in the unlocked position.
Figure 20:
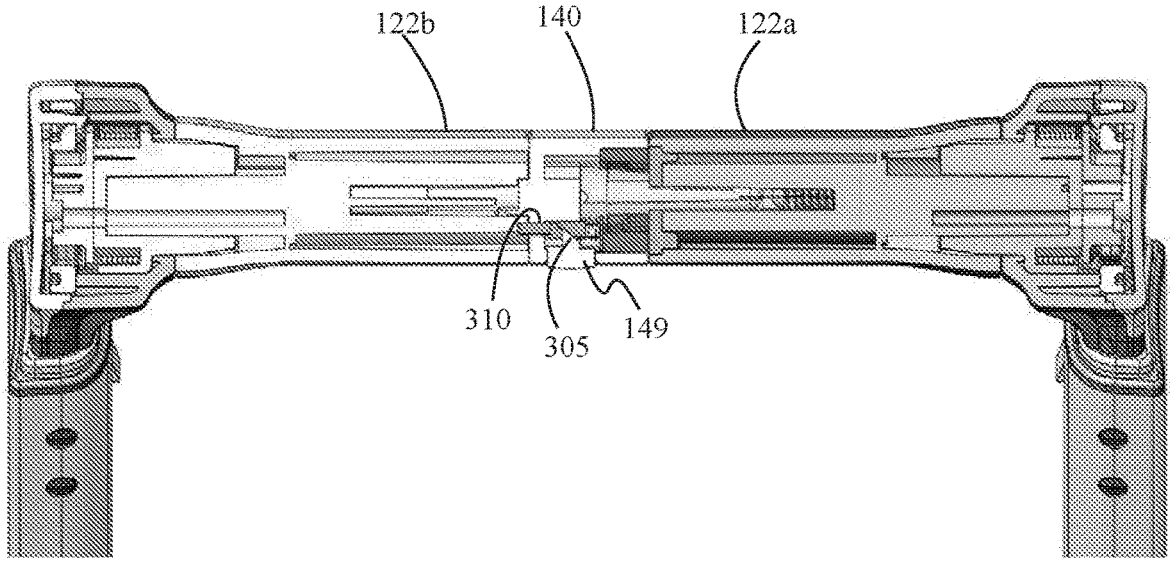
FIG. 20 is a cross sectional view of an alternate embodiment with a quick release button in the handle.
Figure 21:
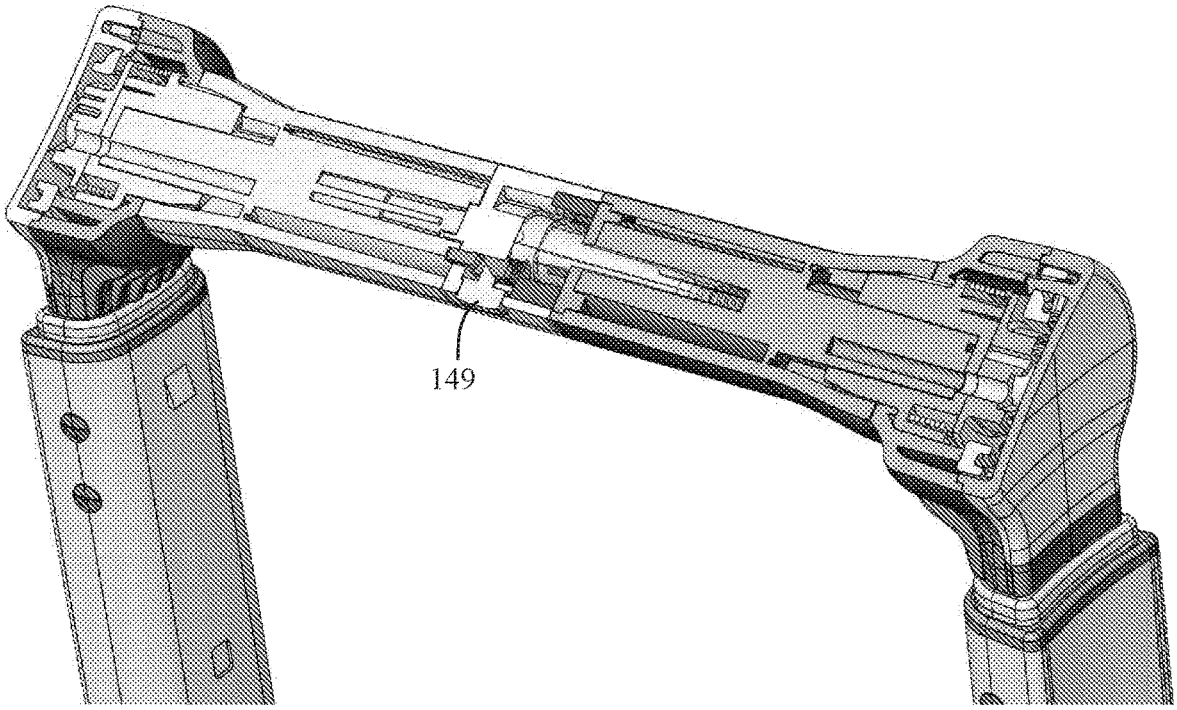
FIG. 21 is an elevated, perspective view of the cross section of FIG. 20.
Figure 22:
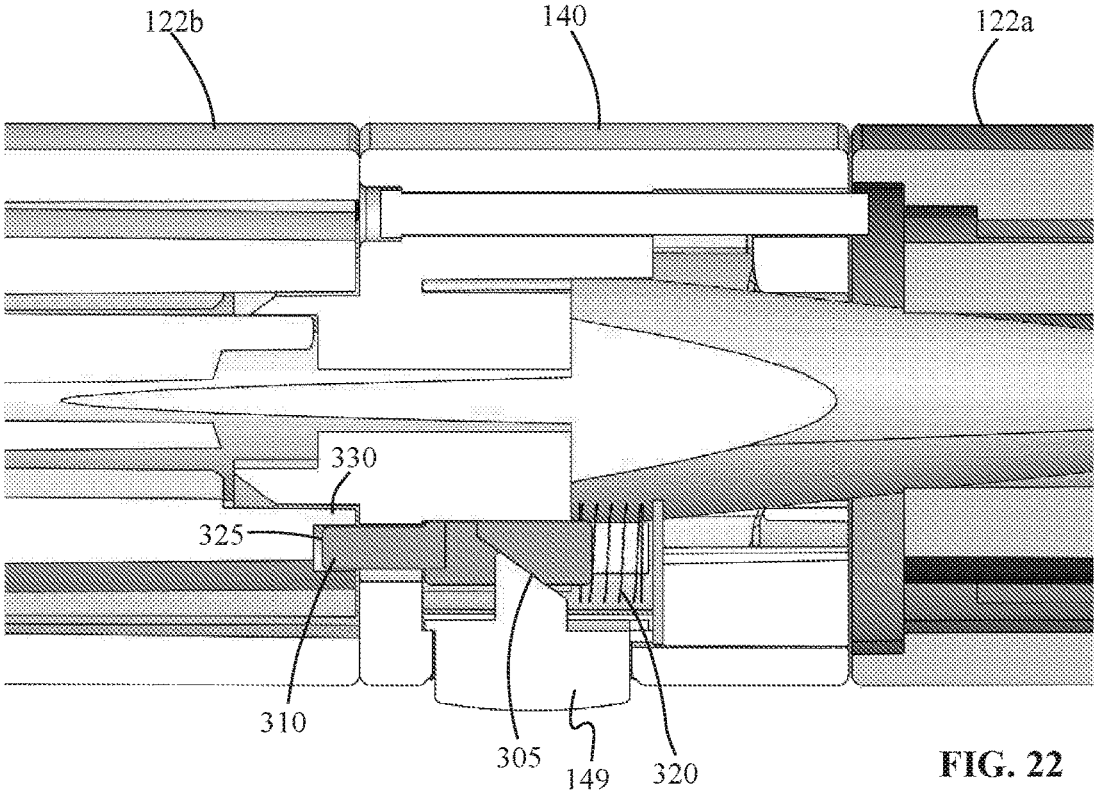
FIG. 22 is an enlarged, cross sectional view of the release button of FIG. 20.
Figure 23:
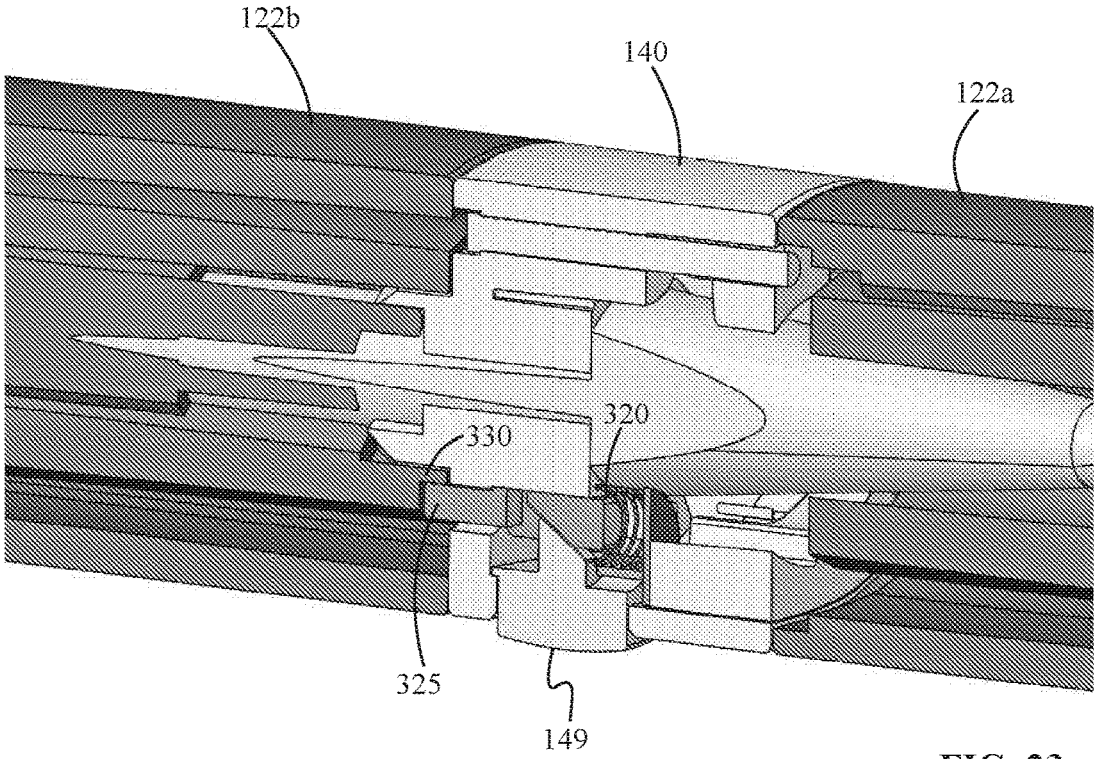
FIG. 23 is an enlarged, elevated perspective view of the cross section of FIG. 22.
Figure 24:
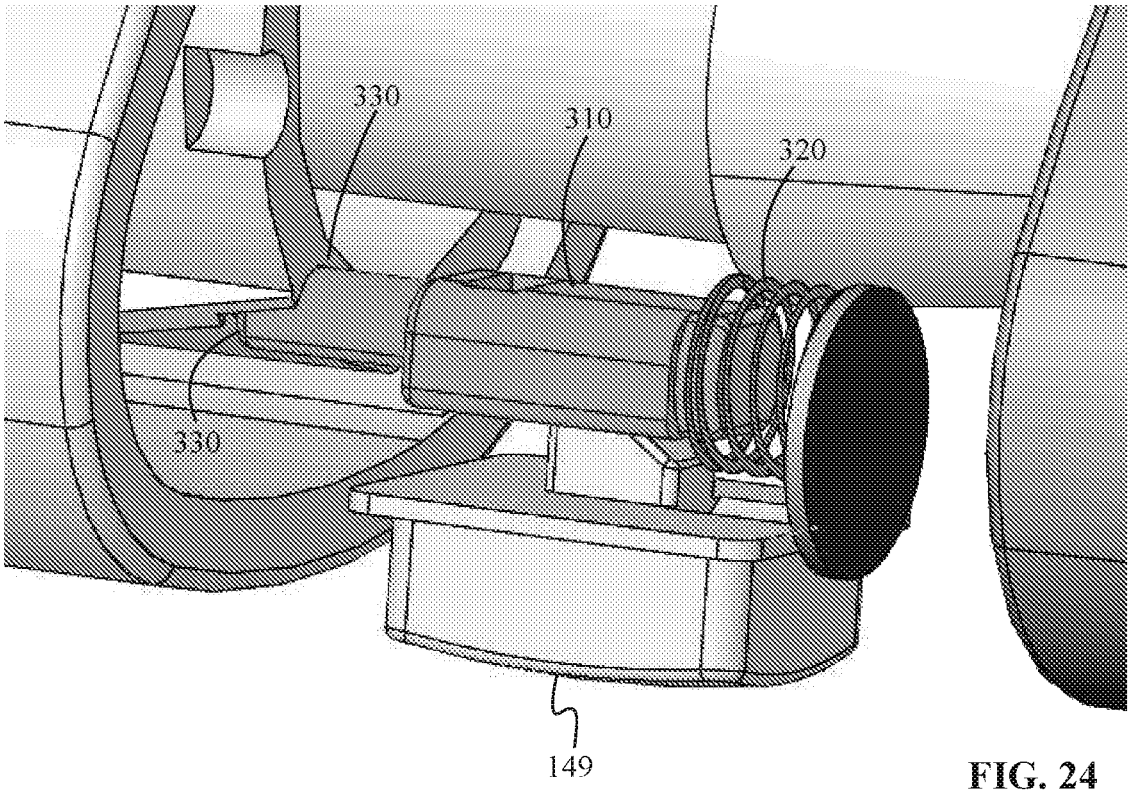
FIG. 24 is a further enlarged sectional view of the button of FIG. 20.

FIGS. 20-24 illustrate a preferred embodiment of the operation of the release button 149 on the split handle. The button 149 is incorporated into the actuator 140 and its exposed surface is slightly curved and biased to sit slightly out of the plane of the handle (FIG. 20). Opposite the slightly curved exposed surface is an angled member 305 that bears against a similarly angled surface of a drive pin 310. The drive pin 310 is biased in the handle by a spring 320 that pushes the button 149 out of the handle. The spring 320 also places the end 325 of the drive pin 310 into an interference position with the end 330 of the split handle 122, such that the actuator 140 cannot rotate as shown in FIG. 6. However, when the button 149 is depressed, the angled member 305 bears against and forces the drive pin 310 toward the spring 320 and out of interference with the split handle end 330. This removal of the interference between the drive pin end 325 and the split handle end 330 then allows the actuator 140 to rotate about the central locking pin. The quick release button allows the split handle to safely remain closed until the user depresses the button 149, whereupon the actuator can be rotated and the handle separated as shown in FIG.

The present invention is not limited to either hard shell or soft shell bags, and may include wheels of different types and numbers than those illustrated herein. Alternatively, the invention may include sliders, hinged fixed wheels, casters, track wheels, ski-type supports, or even motorized wheels. The split handle can employ locking mechanisms different from those described and depicted herein, including mechanical, electrical, electromechanical, magnetic, etc. locking mechanisms. The handle may split evenly, or non-symmetrically, and the locking mechanism may be centrally disposed or non-centrally located. The case may include a motorized system for following a user or tracking purpose. The shafts that connect the handle may be linear or curvilinear, where a curvilinear shaft can avoid the channel passing directly across the middle of the packing space. The shafts may operate independently of each other, extending to different lengths if needed.

The present invention is capable of many alternations, substitutions, and modifications that are readily appreciated by a person of ordinary skill in the art, and the scope of the invention is intended to include all such alterations, substitutions, and modifications. Accordingly, unless expressly stated, the invention is not limited to any description or depiction in the figures, but rather the invention is to be governed by the claims accompanying the application.

I claim:

1. A suitcase having a plurality of rolling elements along a lower surface, the suitcase when the plurality of rolling elements are in contact with a ground surface has a height defined by an upper surface and the ground surface, a width defined by a front side and a rear side, and a depth defined by a left side and a right side, the depth having a length that is less than a length of the width and less than a length of the height, the suitcase comprising:

a first pair of wheels at a front lower edge, the first pairs of wheels inset from the left side, the right side, and the front side;

a second pair of wheels at a rear lower edge, the second pair of wheels inset from the left side and the right side, the second pair of wheels having a diameter that is larger than a diameter of the first pair of wheels;

an extendable handle having first and second arms seated in channels of the left and right sides, respectively, the seated arms slidable entirely within the respective channels, and a grip member connecting the first and second arms at respective distal ends, the grip member separable into first and second components;

wherein the suitcase is capable of being opened when the grip member is separated into the first and second components, and is incapable of being opened when the grip member is locked into a single structure.

2. The suitcase of claim 1, wherein the second pair of wheels do not share a common transverse axle.

3. The suitcase of claim 1, wherein the first pair of wheels spin about a vertical axis.

4. The suitcase of claim 1, wherein one of the first and second components of the grip member includes a locking actuator that locks the first and second components into a single structure.

5. The suitcase of claim 4, wherein the locking actuator shares in a first position a common profile with a profile of the first and second components of the grip member, and rotates out of conformity with the first and second components of the grip member in a second position.

6. The suitcase of claim 5, wherein the locking actuator includes a release button that releases locking actuator to rotate out of conformity with the first and second components of the grip member.

7. The suitcase of claim 6, further comprising a spring member biasing the locking actuator in the first position.

8. The suitcase of claim 7, wherein the release button and locking actuator are arranged such that, by grasping the grip member with one hand a user's thumb may depress the release button and rotate the locking actuator against the bias of the spring member to separate the grip member into the first and second components.

9. The suitcase of claim 8, wherein one of the components of the grip member comprises a support pin that is insertable into a cylindrical projection on the other component of the grip member to reinforce a connection of the grip member.

10. The suitcase of claim 9, further comprising an opening about the support pin having channels that coincide with tabs on the cylindrical projection such that the grip member can separate into first and second components only when the locking actuator is rotated to an unlocked position where the tabs align with the channels of the opening.

11. The suitcase of claim 1, further comprising first and second protective shield plates enclosing the grip member at first and second ends respectively.

12. The suitcase of claim 1, wherein a rotation of the grip member releases the first and second arms from their respective channels so as to extend away from the rear side into a telescoped position.

13. The suitcase of claim 12, wherein a reverse rotation of the grip member locks the first and second arms in current position.

14. The suitcase of claim 12, wherein the first and second arms are curved.

15. The suitcase of claim 1, wherein the upper surface and rear side cooperate to form first and second C-shaped barriers that partially enclose and protect first and second ends of the grip member.

* * * * *